US009079296B1

(12) United States Patent
Martucci

(10) Patent No.: US 9,079,296 B1
(45) Date of Patent: Jul. 14, 2015

(54) SWIVELING RATCHET

(71) Applicant: Anthony Martucci, Hauppage, NY (US)

(72) Inventor: Anthony Martucci, Hauppage, NY (US)

( * ) Notice: Subject to any disclaimer, the term of this patent is extended or adjusted under 35 U.S.C. 154(b) by 276 days.

(21) Appl. No.: 13/868,158

(22) Filed: Apr. 23, 2013

(51) Int. Cl.
*B25B 17/00* (2006.01)
*B25G 1/06* (2006.01)

(52) U.S. Cl.
CPC ..... *B25B 17/00* (2013.01); *B25G 1/063* (2013.01)

(58) Field of Classification Search
CPC ..... B25B 17/00; B25B 13/06; B25B 13/481; B25B 23/0028; B25G 1/063
USPC ..... 81/57.29, 57.39, 177.8, 177.7
See application file for complete search history.

(56) References Cited

U.S. PATENT DOCUMENTS 2,787,180 A * 4/1957 Fish ..... 81/57.29
4,003,275 A * 1/1977 Smith ..... 81/57.29
4,524,649 A * 6/1985 Diaz et al. ..... 81/57.29
4,901,608 A 2/1990 Shieh
4,905,548 A 3/1990 Colace et al.
4,993,288 A * 2/1991 Anderson et al. ..... 81/57.39
5,775,184 A 7/1998 Cole
6,112,625 A 9/2000 Tuttle
6,220,125 B1 4/2001 Lan
6,267,681 B1 7/2001 Clevelan, III
D467,154 S 12/2002 Song
6,536,310 B2 * 3/2003 Goldfein ..... 81/57.29
6,886,429 B1 5/2005 Lee
D603,234 S 11/2009 Lin

* cited by examiner

*Primary Examiner* — Hadi Shakeri
(74) *Attorney, Agent, or Firm* — Kyle A. Fletcher, Esq

(57) ABSTRACT

The swiveling ratchet involves a rotating socket that is in mechanical communication with a drive ratchet, which is able to rotate there between. The drive ratchet is driven via a handle that would rotate about a longitudinal axis. The rotating socket is rotated via a worm gear positioned inside of a socket housing. The worm gear features drive gears at distal ends. The drive gears are both in mechanical communication with a bevel gear that extends to the drive ratchet. Both the drive ratchet and the bevel gear freely rotate about a worm axis, which enables the handle and drive ratchet to rotate collectively with respect to the socket housing, and maintaining mechanical communication between the drive ratchet and rotating socket.

17 Claims, 4 Drawing Sheets

SWIVELING RATCHET

CROSS REFERENCES TO RELATED APPLICATIONS

Not applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hand tools, more specifically, a ratcheting tool that swivels.

B. Discussion of the Prior Art

As will be discussed immediately below, no prior art discloses a rotating socket in mechanical communication with a drive ratchet, which is able to rotate therebetween; wherein the drive ratchet would connect with a handle that would rotate about a longitudinal axis; wherein the rotating socket is rotated via a worm gear positioned inside of a socket housing; wherein the worm gear features drive gears at distal ends; wherein the drive gears are both in mechanical communication with a bevel gear that extends to the drive ratchet; wherein both the drive ratchet and the bevel gear freely rotate about a worm axis, which enables the handle and drive ratchet to rotate stationary, and maintaining mechanical communication between the drive ratchet and rotating socket.

The Shieh Patent (U.S. Pat. No. 4,901,608) discloses an adjustable angle ratchet wrench having a head and handle hinged about a bolt. However, the adjustable angle is not freely rotating between the drive ratchet and rotating socket while continuously providing mechanical intercommunication therebetween.

The Anderson et al. Patent (U.S. Pat. No. 4,993,288) discloses a power driven socket holding ratchet wrench capable of being positioned at an angle relative to the wrench head. However, the angle is not freely rotating while maintaining mechanical intercommunication between the drive ratchet and rotating socket.

The Cole Patent (U.S. Pat. No. 5,775,184) discloses an indexable wrench that can be angularly adjusted to rotate a nut or bolt in the conventional manner while avoiding contact between the handle and an obstruction. However, the wrench does not provide a drive ratchet to rotate with respect to the rotating socket while maintaining mechanical intercommunication therebetween.

The Lan Patent (U.S. Pat. No. 6,220,125) discloses a ratchet wrench with an angle adjusting device. However, the ratchet wrench does not include a worm gear having drive gears at distal end that maintain mechanical communication with a bevel gear of the drive ratchet.

The Lee Patent (U.S. Pat. No. 6,886,429) discloses a ratchet wrench having a pivotal head so that the operational angle of the head relative to the handle can be changed. However, the ratchet wrench does not provide for a drive ratchet that rotates along a longtiudinal axis of a handle, and which maintains mechanical communication with the rotating socket while also freely rotating therebetween.

The Turtle Patent (U.S. Pat. No. 6,112,625) discloses a wrench apparatus that includes a wrench head with a swivel adaptor, a combination handle and extension bar attachable to the swivel adapter and a ratchet head. However, the wrench does not teach a rotating socket in mechanical communciation with a worm gear having distally opposite drive gears communcable to a bevel gear thereby enabling swivel motion to occur therebetween.

The Colace et al. Patent (U.S. Pat. No. 4,905,548) discloses an adjustable extension that is designed for being employed with ratchet and hinge handle wrenches. However, the extension does not provide swivel action between a rotating socket and drive ratchet.

While the above-described devices fulfill their respective and particular objects and requirements, they do not describe a rotating socket in mechanical communication with a drive ratchet, which is able to rotate therebetween; wherein the drive ratchet would connect with a handle that would rotate about a longitudinal axis; wherein the rotating socket is rotated via a worm gear positioned inside of a socket housing; wherein the worm gear features drive gears at distal ends; wherein the drive gears are both in mechanical communication with a bevel gear that extends to the drive ratchet; wherein both the drive ratchet and the bevel gear freely rotate about a worm axis, which enables the handle and drive ratchet to rotate collectively with respect to the socket housing, and maintaining mechanical communication between the drive ratchet and rotating socket. In this regard, the swiveling ratchet departs from the conventional concepts and designs of the prior art.

SUMMARY OF THE INVENTION

The swiveling ratchet involves a rotating socket that is in mechanical communication with a drive ratchet, which is able to rotate there between. The drive ratchet is driven via a handle that would rotate about a longitudinal axis. The rotating socket is rotated via a worm gear positioned inside of a socket housing. The worm gear features drive gears at distal ends. The drive gears are both in mechanical communication with a bevel gear that extends to the drive ratchet. Both the drive ratchet and the bevel gear freely rotate about a worm axis, which enables the handle and drive ratchet to rotate collectively with respect to the socket housing, and maintaining mechanical communication between the drive ratchet and rotating socket.

An object of the invention is to provide a drive ratchet and rotating socket that maintain mechanical communication while enabling the drive ratchet to freely rotate about a worm gear axis.

A further object of the invention is to provide a worm gear that drives the rotating socket, and which includes drive gears at distal ends, and wherein the drive gears maintain mechanical communication with a bevel gear that is communicable to the drive ratchet.

A further object of the invention is to provide a drive ratchet that is rotated via a handle, which spins about a longitudinal axis.

These together with additional objects, features and advantages of the swiveling ratchet will be readily apparent to those of ordinary skill in the art upon reading the following detailed description of presently preferred, but nonetheless illustrative, embodiments of the swiveling ratchet when taken in conjunction with the accompanying drawings.

In this respect, before explaining the current embodiments of the swiveling ratchet in detail, it is to be understood that the swiveling ratchet is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the swiveling ratchet.

It is therefore important that the claims be regarded as including such equivalent construction insofar as they do not depart from the spirit and scope of the swiveling ratchet. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
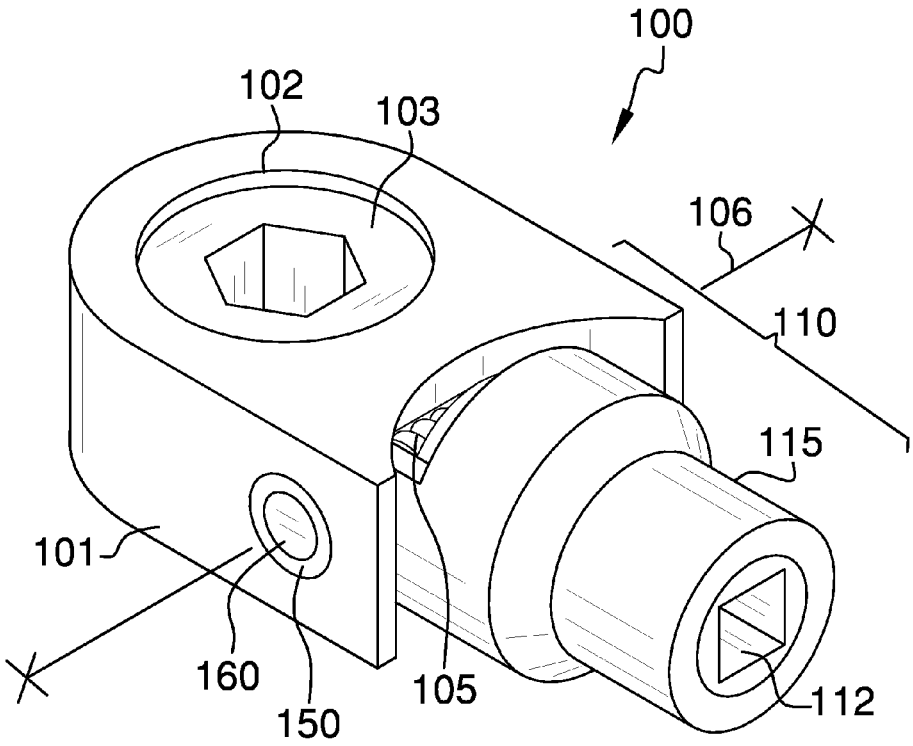
FIG. 1 illustrates a front, perspective view of the swiveling ratchet in a straightened orientation.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-7. A swiveling ratchet 100 (hereinafter invention) includes a socket housing 101 of hollowed construction and featuring socket openings 102 thereon, which enable access to a rotating socket 103 housed therein. The rotating socket 103 performs the output of the invention 100 when in use, and is primarily designed for use in rotating nuts, bolts, or other hexagonally-shaped fasteners. The rotating socket 103 is encased inside of the housing 101, and includes socket gear teeth 104 along a periphery. The socket gear teeth 104 of the rotating socket 103 are in mechanical communication with a worm gear 105 located inside of the housing 101. The worm gear 105 extends along a worm gear axis 106, which is a major attribute of the invention 100.

The worm gear 105 includes drive gears 107 at distal ends of the worm gear 105. The drive gears 107 are responsible for rotating the worm gear 105, which in turn rotates the rotating socket 103 via the socket gear teeth 104. The invention 100 includes a drive ratchet 110, which extends from within the housing 101 outwardly. The drive ratchet 110 is responsible for inputting rotational mechanical movement into the drive gears 107. The drive ratchet 110 includes a bevel gear 111 that is perpendicularly oriented with the drive gears 107. Also, it shall be noted that the bevel gear 111 is perpendicularly oriented with respect to the worm gear 105. The bevel gear 111 is in mechanical communication with at least one of the drive gears 107. Moreover, the bevel gear 111 is optimally in simultaneous mechanical communication with the drive gears 107.

The drive ratchet 110 includes a square shaped receptacle 112 at a distal end opposite of the bevel gear 111. The square shaped receptacle is adapted for use with a square driven handle 120, which is rotated about a longitudinal axis 121. Thus, the square driven handle 120 is connected with and mechanical communication with the square shaped receptacle 112, and is rotated collectively via a handle portion 122 in order to rotate the drive ratchet 110. Obviously clockwise rotation of the square drive handle 120 will rotate the rotating socket 103 in a first direction, whereas counterclockwise rotation of the square drive handle 120 will rotate the rotating socket 103 in a second direction.

The main benefit of the invention 100 is the ability of the drive ratchet 110 to rotate about the worm gear axis 106 while maintaining mechanical communication with the rotating socket 103.

Figure 6:
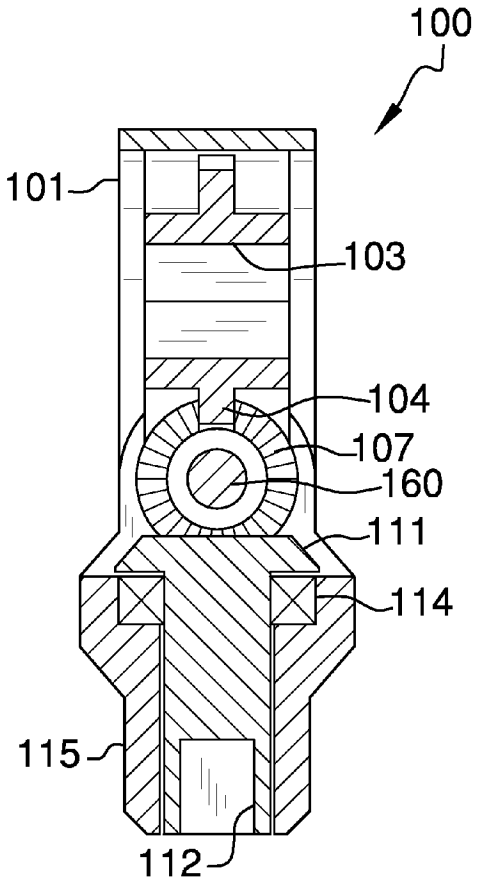
FIG. 6 illustrates a cross-sectional view of the swiveling ratchet along line 6-6 in FIG. 5, and depicting the mechanical communication of the worm gear and the rotating socket as well as the bevel gear in mechanical communication with one of the drive gears.
Figure 5:
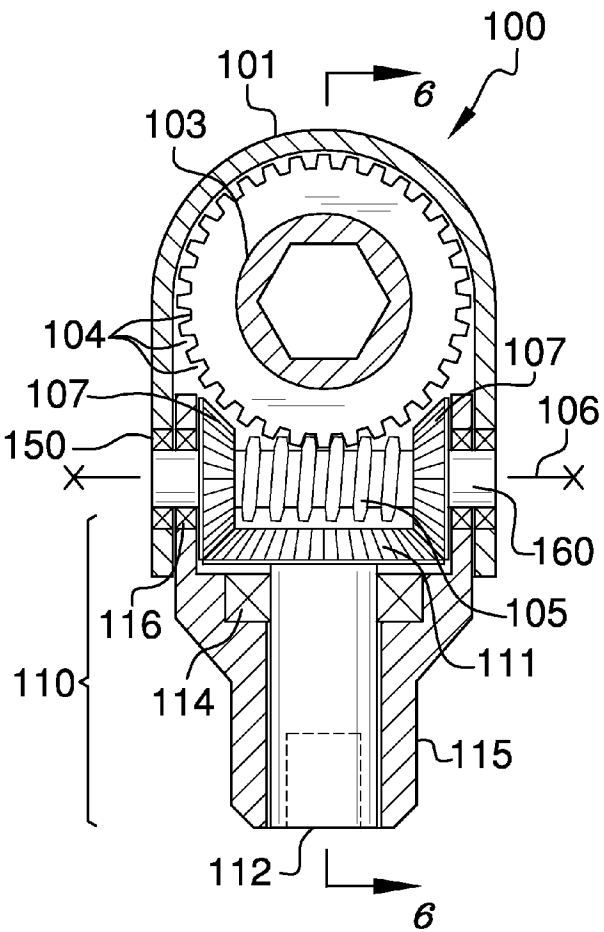
FIG. 5 illustrates a cross-sectional view of the swiveling ratchet along line 5-5 in FIG. 2, and detailing the worm gear in mechanical communication with the rotating socket as well as the drive gears being both in mechanical communication with the bevel gear that extends to the drive ratchet.
Figure 7:
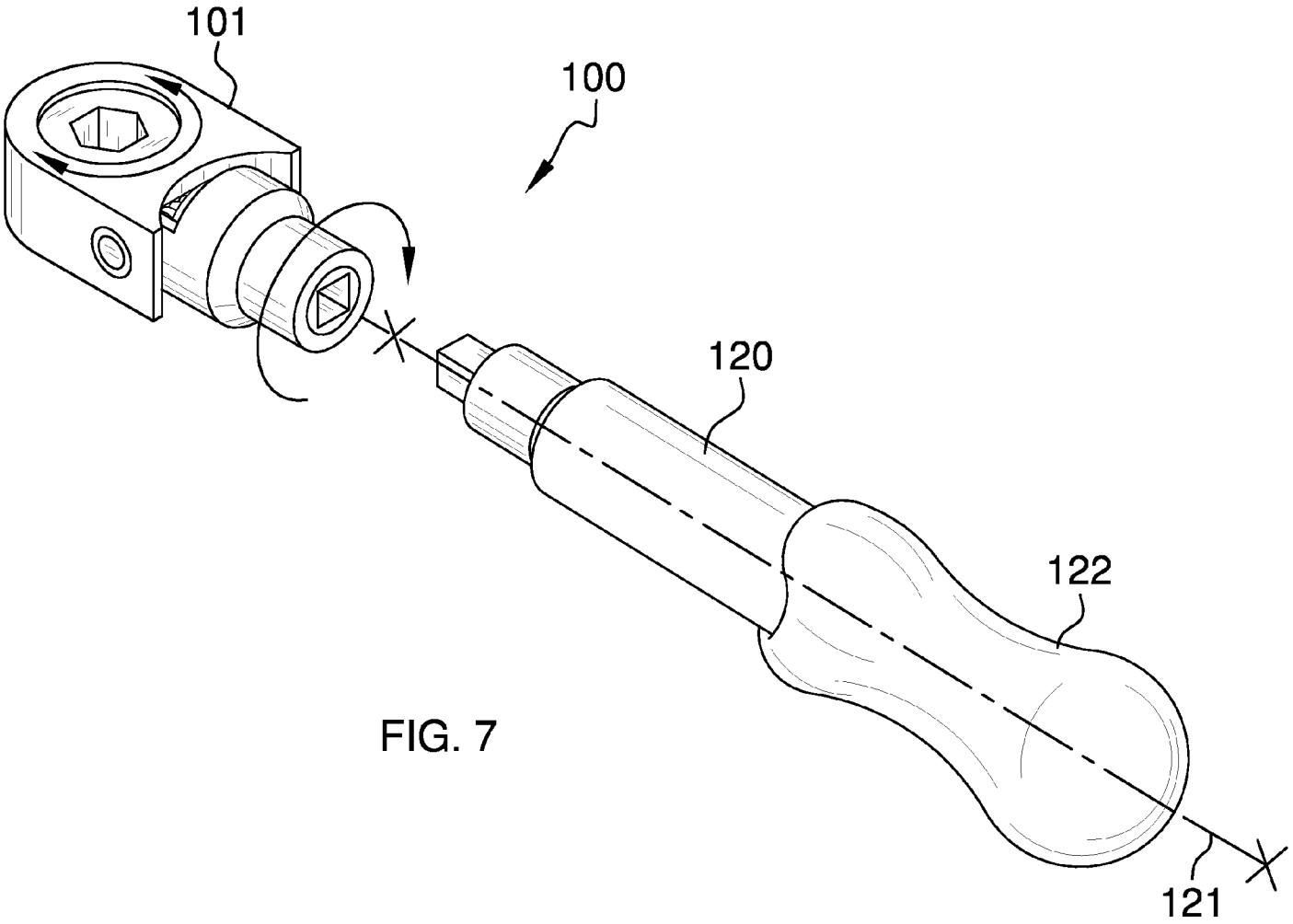
FIG. 7 illustrates a perspective view of the swiveling ratchet in a straightened position and aligned adjacent to a handle having a square member for connection with the drive ratchet, and further detailing rotational movement about the longitudinal axis thereby indicating use in rotating the drive ratchet.

Referring to FIGS. 5-6, the invention 100 includes the use of a ratchet bearing 114, which enables the bevel gear 111 to rotate with respect to a ratchet housing 115. Moreover, the ratchet housing 115, ratchet housing bearings 116, the ratchet bearing 114, the bevel gear 111, and the square shaped receptacle 112 shall constitute the drive ratchet 110. It shall be noted that the ratchet housing bearings 116 provide rotational movement of the ratchet housing 115 with respect to the socket housing 101. Moreover, the ratchet housing bearings 116 connect between the ratchet housing 115 and a worm gear shaft 160.

The worm gear shaft 160 includes the worm gear 105 and the drive gears 107. Moreover, the worm gear shaft 160 defines the worm gear axis 106. The socket housing 101 also includes socket bearings 150, which provide for rotational movement between the socket housing 101 and the worm gear shaft 160.

Figure 3:
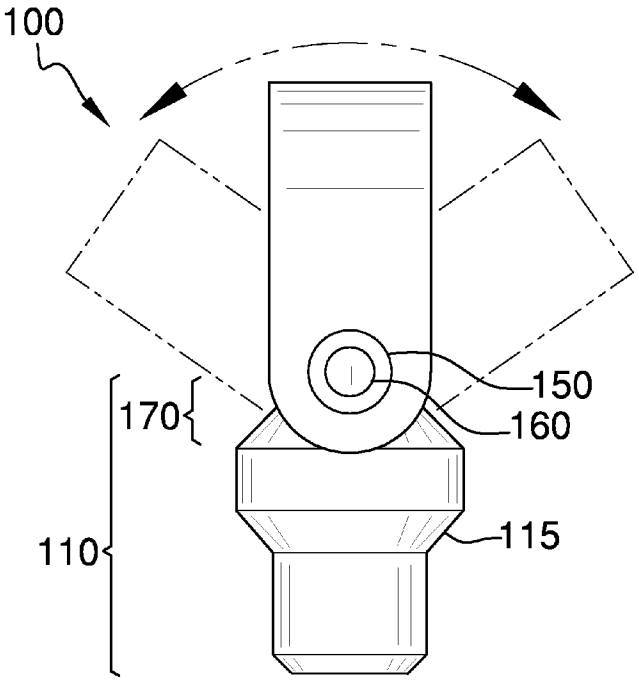
FIG. 3 illustrates a side view of the swiveling ratchet wherein detail is provided as to the rotation of the drive ratchet with respect to the socket housing.
Figure 4:
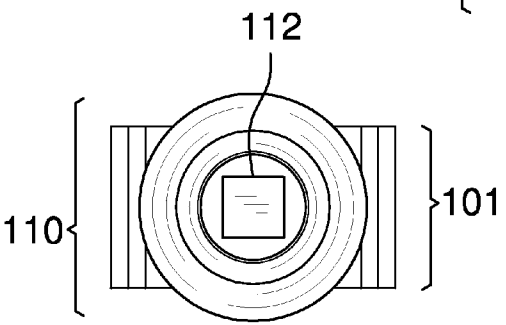
FIG. 4 illustrates an end view of the swiveling ratchet and detailing the square drive shape of the drive ratchet.
Figure 2:
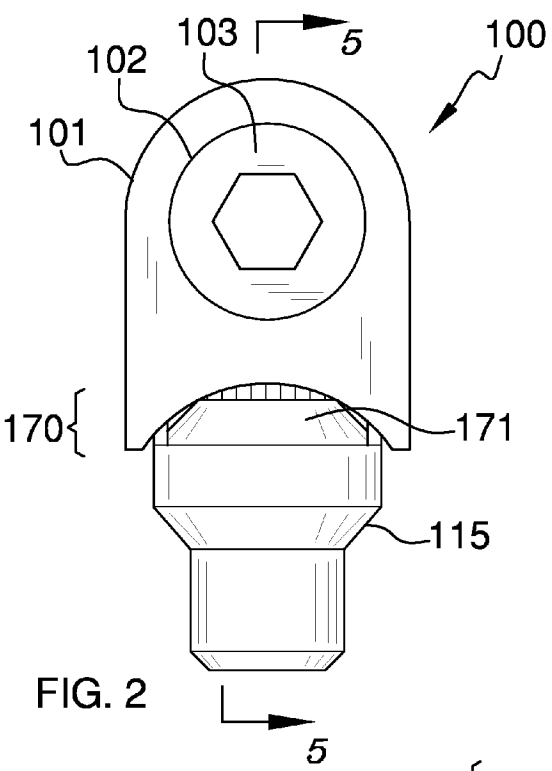
FIG. 2 illustrates a top view of the swiveling ratchet in a straightened orientation.

It should be further defined that the socket housing 101 includes a ratchet opening 170, which accommodates an enables the drive ratchet 110 to rotate with respect to the worm gear axis 106 as well as to rotate the drive gears 107 via the bevel gear 111. That being said the size and shape of the ratchet opening 170 in the socket housing 101 will dictate the range in rotation of the drive ratchet 110 with respect to the socket housing 101. Referring to FIG. 3, the ratchet housing 115 has a curved portion 171 that curves inwardly in order to maximize the rotational efficiency of the drive ratchet 110 with respect to the socket housing 101.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A swiveling ratchet comprising:

a socket housing into which a rotating socket is encased and in mechanical communication with a worm gear also located inside of the socket housing;

wherein drive gears provided on distal ends of the worm gear are in mechanical communication with a bevel gear that extends outwardly from the socket housing and to which a drive ratchet is provided and adapted for use with a square driven handle such that the square driven handle is rotated along a longitudinal axis thereby rotating the worm gear, which in turn rotates the rotating socket;

wherein the drive ratchet is able to rotate about a worm gear axis while maintaining mechanical communication between the rotating socket and the bevel gear of the drive ratchet.

2. The swiveling ratchet as described in claim 1 wherein the socket housing is of hollowed construction and includes socket openings thereon, which enable access to the rotating socket housed therein.

3. The swiveling ratchet as described in claim 2 wherein the rotating socket includes socket gear teeth along a periphery, which engages against the worm gear.

4. The swiveling ratchet as described in claim 3 wherein the bevel gear is perpendicularly oriented with respect to the worm gear; wherein the bevel gear is in mechanical communication with at least one of the drive gears.

5. The swiveling ratchet as described in claim 4 wherein the drive ratchet includes a square shaped receptacle at a distal end opposite of the bevel gear; wherein the square shaped receptacle is adapted for use with the square driven handle, which is rotated about the longitudinal axis.

6. The swiveling ratchet as described in claim 5 wherein a ratchet bearing enables the bevel gear to rotate with respect to a ratchet housing.

7. The swiveling ratchet as described in claim 6 wherein the ratchet housing includes ratchet housing bearings, which provide rotational movement of the ratchet housing with respect to the socket housing.

8. The swiveling ratchet as described in claim 7 wherein the ratchet housing bearings connect between the ratchet housing and a worm gear shaft; wherein the worm gear shaft includes the worm gear and the drive gears.

9. The swiveling ratchet as described in claim 8 wherein the socket housing includes a ratchet opening, which accommodates and enables the drive ratchet to rotate with respect to the worm gear axis as well as to rotate the drive gears via the bevel gear.

10. A swiveling ratchet comprising:

a socket housing into which a rotating socket is encased and in mechanical communication with a worm gear also located inside of the socket housing;

wherein drive gears provided on distal ends of the worm gear are in mechanical communication with a bevel gear that extends outwardly from the socket housing and to which a drive ratchet is provided and adapted for use with a square driven handle such that the square driven handle is rotated along a longitudinal axis thereby rotating the worm gear, which in turn rotates the rotating socket;

wherein the drive ratchet is able to rotate about a worm gear axis while maintaining mechanical communication between the rotating socket and the bevel gear of the drive ratchet;

wherein the socket housing is of hollowed construction and includes socket openings thereon, which enable access to the rotating socket housed therein.

11. The swiveling ratchet as described in claim 10 wherein the rotating socket includes socket gear teeth along a periphery, which engages against the worm gear.

12. The swiveling ratchet as described in claim 11 wherein the bevel gear is perpendicularly oriented with respect to the worm gear; wherein the bevel gear is in mechanical communication with at least one of the drive gears.

13. The swiveling ratchet as described in claim 12 wherein the drive ratchet includes a square shaped receptacle at a distal end opposite of the bevel gear; wherein the square shaped receptacle is adapted for use with the square driven handle, which is rotated about the longitudinal axis.

14. The swiveling ratchet as described in claim 13 wherein a ratchet bearing enables the bevel gear to rotate with respect to a ratchet housing.

15. The swiveling ratchet as described in claim 14 wherein the ratchet housing includes ratchet housing bearings, which provide rotational movement of the ratchet housing with respect to the socket housing.

16. The swiveling ratchet as described in claim 15 wherein the ratchet housing bearings connect between the ratchet housing and a worm gear shaft; wherein the worm gear shaft includes the worm gear and the drive gears.

17. The swiveling ratchet as described in claim 16 wherein the socket housing includes a ratchet opening, which accommodates and enables the drive ratchet to rotate with respect to the worm gear axis as well as to rotate the drive gears via the bevel gear.

* * * * *